US010434776B2

(12) United States Patent
Furukawa

(10) Patent No.: US 10,434,776 B2
(45) Date of Patent: Oct. 8, 2019

(54) METHOD FOR MANUFACTURING LIQUID EJECTION HEAD

(71) Applicant: CANON KABUSHIKI KAISHA, Tokyo (JP)

(72) Inventor: Masao Furukawa, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 274 days.

(21) Appl. No.: 15/156,687

(22) Filed: May 17, 2016

(65) Prior Publication Data

US 2016/0355017 A1 Dec. 8, 2016

(30) Foreign Application Priority Data

Jun. 3, 2015 (JP) ..... 2015-113096

(51) Int. Cl.
*B41J 2/16* (2006.01)

(52) U.S. Cl.
CPC ..... *B41J 2/1623* (2013.01); *B41J 2/1601* (2013.01); *B41J 2202/19* (2013.01)

(58) Field of Classification Search
CPC ..... B41J 2/1623; B41J 2/1601; B41J 2202/19
USPC ..... 156/273, 72
See application file for complete search history.

(56) References Cited

U.S. PATENT DOCUMENTS 4,976,802 A * 12/1990 LeBlanc ..... H01L 25/042 156/273.5
5,034,083 A * 7/1991 Campanelli ..... B41J 2/155 156/273.5
5,272,113 A * 12/1993 Quinn ..... G06K 7/10841 156/80
5,473,513 A * 12/1995 Quinn ..... G06K 7/10841 257/E21.505
6,499,828 B1 * 12/2002 Iketani ..... B41J 2/155 347/42
7,871,153 B2 1/2011 Hayashi
2003/0157861 A1 * 8/2003 Furukawa ..... H01J 11/12 445/24

FOREIGN PATENT DOCUMENTS

JP 2007320108 * 5/2006
JP 2008-001085 A 1/2008
JP 2014094469 * 11/2012

* cited by examiner

*Primary Examiner* — Michael N Orlando
*Assistant Examiner* — Christian Roldan
(74) *Attorney, Agent, or Firm* — Venable LLP

(57) ABSTRACT

The present invention relates the method of manufacturing a liquid discharge head, in which a plurality of element substrates are adjacently arranged in a predetermined direction on a support plate by using a UV adhesive. The method for manufacturing a liquid ejection head is capable of reducing variations in the positions of element substrates while avoiding an increase of a tact time.

13 Claims, 10 Drawing Sheets

METHOD FOR MANUFACTURING LIQUID EJECTION HEAD

BACKGROUND OF THE INVENTION

Field of the Invention

The present invention relates to a method for manufacturing a liquid ejection head.

Description of the Related Art

An apparatus having a liquid ejection head (e.g. a recording apparatus) is extensively used as a computer-related output apparatus and the like. As the liquid ejection head, there has been known one that has an element substrate provided with a supply port of a liquid, such as an ink, a pressure chamber in communication with the supply port, an ejection energy generating unit, and an ejection orifice through which a liquid is ejected by the energy generated by the ejection energy generating unit. As the ejection energy generating unit, an electrothermal transducer or a piezoelectric element is used.

As a typical recording apparatus having a liquid ejection head, there has been widely known a type adapted to perform scanning and recording on a recording medium, such as paper, by the liquid ejection head while ejecting a liquid from the liquid ejection head.

In recent years, there has been a demand for a liquid ejection head having a larger printing width in order to achieve higher speed recording. There has also been known a recording apparatus in which a liquid ejection head having a larger printing width is disposed on a conveying belt that conveys a recording medium, and which is capable of printing at a higher speed by scanning the recording medium.

To make the liquid ejection head having such a large printing width by a single element substrate, it is necessary to use a longer element substrate. However, this would lead to a problem of, for example, a lower yield of the element substrate itself. For this reason, Japanese Patent Application Laid-Open No. 2008-001085 proposes a configuration in which a plurality of piezoelectric element units having an appropriate length are linearly joined to a support member (an element substrate fixing member) thereby realizing a liquid ejection head having a larger printing width as a whole.

SUMMARY OF THE INVENTION

The present invention is directed to providing a method for manufacturing a liquid ejection head capable of reducing variations in the positions of element substrates while avoiding an increase of a tact time.

According to the present invention, there is provided a method for manufacturing a liquid ejection head, in which a plurality of element substrates for ejecting a liquid are adjacently arranged in a predetermined direction on a support member by using an adhesive that cures by the irradiation of light, the manufacturing method including:

a first application step of applying the adhesive to a plurality of first areas on the support member in which element substrates that are not adjacent to each other among the plurality of element substrates are to be arranged;

a first joining step of carrying out the irradiation of light and the joining of the element substrates for each of the first areas to which the adhesive has been applied in the first application step;

a second application step of applying the adhesive to a plurality of second areas in which the element substrates have not been joined in the first joining step among the plurality of areas on the support member in which the plurality of element substrates are to be arranged; and a second joining step of carrying out the irradiation of light and the joining of the element substrates for each of the second areas to which the adhesive has been applied in the second application step.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

According to the present invention, a first joining step is carried out with an adhesive not yet being applied to second areas adjacent to first areas. Thereby, this makes it possible to prevent the adhesive on the second areas from curing due to the light irradiated to the first areas. Thus, the element substrates can be joined to predetermined positions in the second areas.

Further, the irradiation of light and the joining of the element substrates are separately carried out for the first areas and the second areas, thus permitting a shorter time required from the irradiation of light to the adhesive to the joining of the element substrates. This allows the element substrates to be joined at predetermined positions, so that variations in positions of the element substrates can be reduced.

The adhesive is applied to the plurality of first areas and then the irradiation of light and the joining of the element substrates are carried out for each first area, and the adhesive is applied to the plurality of second areas and then the irradiation of light and the joining of the element substrates are carried out for each second area. Hence, an increase of a tact time can be avoided, as compared with the case where three steps, namely, the application of an adhesive to each element substrate, the irradiation of light, and the joining of the element substrate, are defined as one cycle, and the cycle is repeated for the number of the element substrates.

According to the present invention, variations in the positions of element substrates can be reduced while avoiding an increase of a tact time.

An adhesive is frequently used to join a plurality of element substrates. However, joining a plurality of element substrates by using, for example, an adhesive that characteristically starts curing reaction when ultraviolet rays (UV light) are irradiated thereto (hereinafter referred to also as "the UV adhesive") poses a problem described below with reference to the accompanying drawings.

Figure 15A:
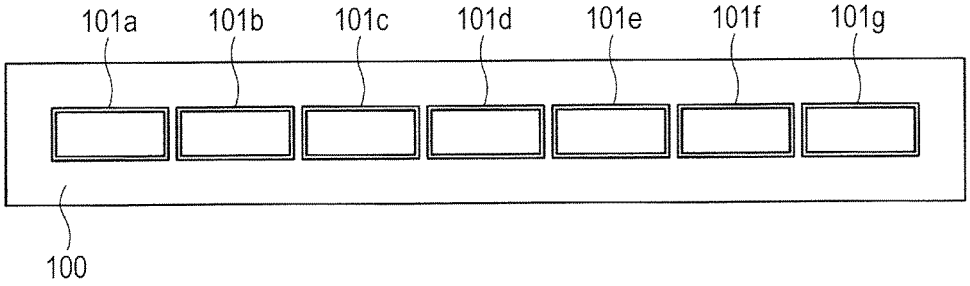
FIGS. 15A, 15B, 15C and 15D are diagrams of a comparative example.

FIGS. 15A to 15D are diagrams illustrating a comparative example. FIG. 15A is a schematic plan view illustrating an adhesive 101 applied to join element substrates to a support member 100.

The UV adhesives 101 (101*a* to 101*g*) has been applied onto the support member 100 to which a plurality of element substrates are to be joined.

Before joining the element substrates, the UV light must be irradiated to the UV adhesive 101. When irradiated by the UV light, the UV adhesive starts the curing reaction and gradually cures. For this reason, the irradiation of the UV light is desirably carried out immediately before an element substrate is joined. At an early stage of the curing of the UV adhesive, the UV adhesive is appropriately squeezed against an element substrate when joining the element substrate, thus allowing the element substrate to be joined at a desired position.

Figure 15B:
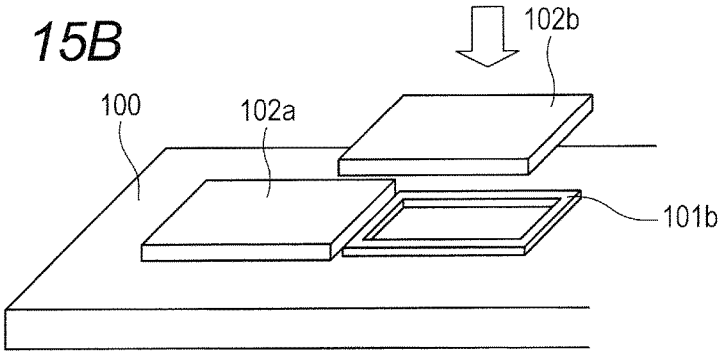
Figure 15C:
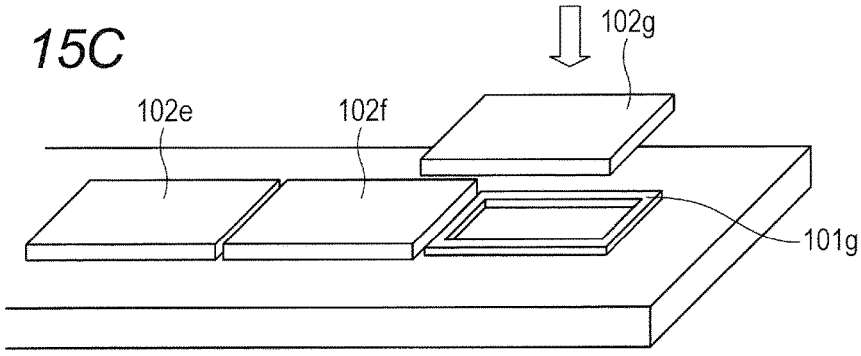

It is assumed that, after irradiating the UV light to all the UV adhesives 101*a* to 101*g* at the same time, the element substrates are joined, one at a time, starting with an element substrate 102*a*, as illustrated in FIG. 15B. In this case, the curing reaction of the UV adhesive 101*b* will have proceeded to a half-cured state by the time the element substrate 102*b* is joined. Then, as illustrated in FIG. 15C, by the time the element substrate 102*g* is joined, the curing reaction of the UV adhesive 101*g* will have further proceeded and may be in a cured state, depending on the properties of the UV adhesive. If the UV adhesive is in the cured state, then the element substrate cannot be joined. Even in the case of a half-cured state of the UV adhesive, since it is difficult to be squeezed, it is difficult to join the element substrate at an accurate position.

The time from the irradiation of the UV light until curing depends on the characteristics of the UV adhesive. In order to securely join the element substrates, the UV light must be individually irradiated to the element substrates one by one.

Figure 15D:
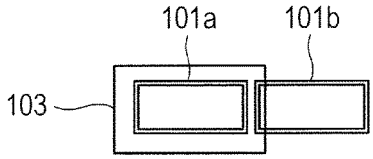

However, applying all the UV adhesives 101*a* to 101*g* in advance and then irradiating the UV light to the UV adhesives 101 for each element substrate would pose a problem described below. As illustrated in FIG. 15D, when irradiating the UV light to the UV adhesive 101*a*, the UV light is irradiated to an area 103, which is slightly larger than the area to which the UV adhesive 101*a* has been applied, in order to securely irradiate the UV light to the whole area of the UV adhesive 101*a*. As a result, the UV light is inconveniently irradiated also to the UV adhesive 101*b* adjacent to the UV adhesive 101*a*. Thus, a part of the UV adhesive 101*b* that has been irradiated with the UV light undesirably starts the curing reaction at that time and will be half cured by the time the element substrate 102*b* is joined. This makes it difficult to join the element substrate at the accurate position, thereby causing variations in positions of the element substrates.

To avoid the problem, three steps, namely, the application of the UV adhesive to each element substrate, the irradiation of the UV light, and the joining of the element substrate, could constitute one cycle, and the cycle could be repeated for the number of the element substrates. This, however, would pose another problem described below.

The element substrates are joined to the support member 100 in a state in which the support member 100 is mounted on a joining device. On the other hand, the UV adhesive is applied to the support member 100 in a state in which the support member 100 is removed from the joining device. Therefore, when the UV adhesive is applied in repeating the foregoing cycle, the support member 100 is temporarily removed from the joining device to apply the UV adhesive and then the support member 100 is mounted back onto the joining device after the application, thereby increasing in the total tact time.

First, a liquid ejection head fabricated using the manufacturing method according to the embodiments will be described with reference to FIGS. 2A to 2C.

Figure 2A:
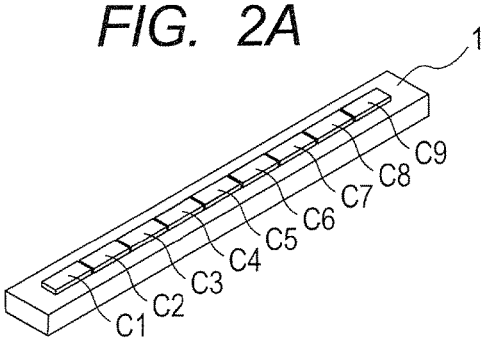
FIGS. 2A, 2B and 2C are diagrams illustrating a liquid ejection head manufactured by a manufacturing method according to embodiments of the present invention.

FIG. 2A is a perspective view illustrating element substrates C (C1 to C9) joined to a support plate 1. The support plate 1 is an example of a support member. As the material of the support plate 1, an alumina material that has insulation properties, thermal conductivity, and mechanical strength is used. The nine element substrates C (C1 to C9) are linearly joined at a predetermined pitch on the top surface of the support plate 1 (on the support member) through a UV adhesive (not illustrated). The plurality of element substrates C do not have to be linearly arranged insofar as the plurality of element substrates C are adjacently arranged in a predetermined direction on the support plate 1.

The nine element substrates C are examples of a plurality of element substrates that eject a liquid. Each of the element substrates C (C1 to C9) has a supply port for a liquid, such as an ink, a pressure chamber in communication with the supply port, an ejection energy generating unit, and an ejection orifice through which a liquid is ejected by the energy generated by the ejection energy generating unit. The element substrates C1 to C9 have, for example, the same or substantially the same shape. The UV adhesive is an example of an adhesive that is cured by the irradiation of light.

Figure 2B:
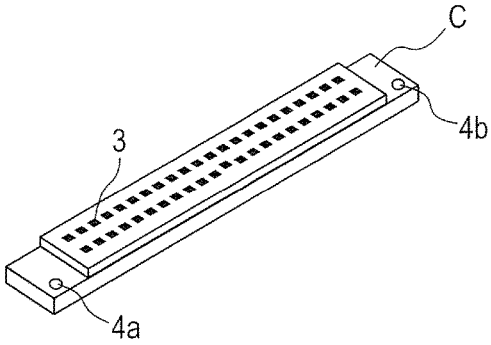

FIG. 2B is a perspective view of the appearance of each of the element substrates C. Each of the element substrates C has a plurality of ejection orifices 3 formed in two lines. The end portions of each of the element substrates C have two circular alignment marks 4 (4*a* and 4*b*). The ejection orifices 3 and the alignment marks 4 are patterned using the same exposure device, thus enabling the ejection orifices 3 and the alignment marks 4 to be formed to have highly accurate relative positions.

The manufacturing method according to the embodiments does not limit the number of the element substrates C to be joined to nine, but may be any other plural number (e.g. four or more). Further, the shape of the element substrates C may be a parallelogram, a trapezoid or the like rather than being limited to a rectangle. Further, the number of the ejection orifices 3 and the number of the lines thereof are not limited to those mentioned above, and the shape of the alignment marks 4 may be, for example, cruciform rather than being limited to the circular shape. Further, the material of the support plate 1 is not limited to alumina and may be a resin or other materials.

Figure 2C:
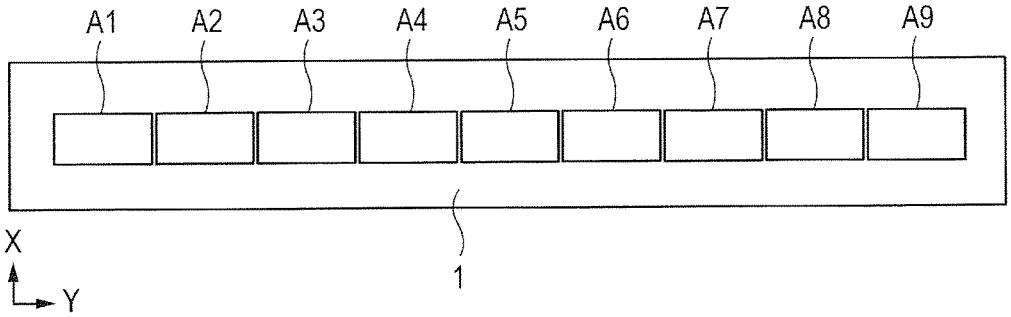

FIG. 2C illustrates areas A1 to A9 on the support plate 1 on which the element substrates C1 to C9 are disposed. The areas A1 to A9 are examples of a plurality of areas on the support plate in which the plurality of element substrates C are disposed.

Figure 3A:
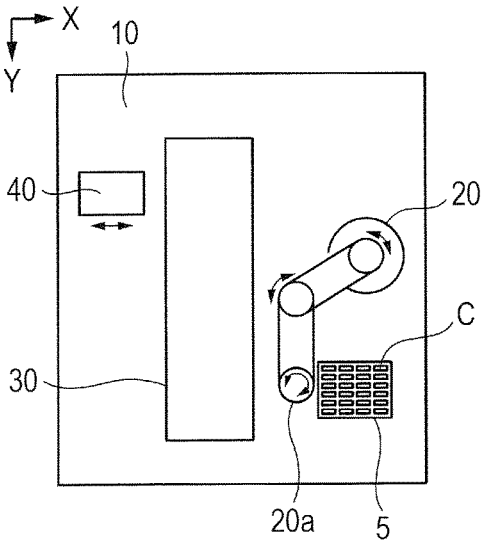
FIGS. 3A, 3B and 3C are diagrams illustrating a mounter that implements the manufacturing method according to the embodiments of the present invention.
Figure 3B:
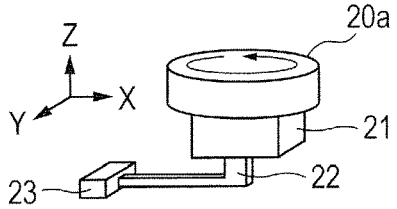
Figure 3C:
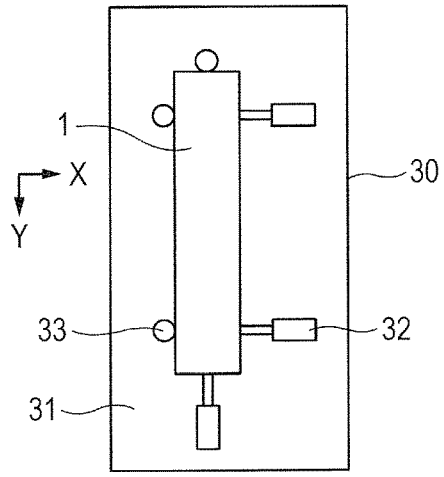

Referring now to FIGS. 3A to 3C, a description will be given of the joining device (hereinafter referred to also as "the mounter"), which joins the element substrates C to the support plate 1 in implementing the manufacturing method according to the embodiments.

FIG. 3A is a plan view schematically illustrating the configuration of a mounter 10. The mounter 10 includes an element substrate conveying unit 20, a support plate fixing and conveying unit 30, and a UV irradiation unit 40.

The element substrate conveying unit 20 takes out, one by one, the element substrates C accommodated in a tray 5, and conveys the element substrates C onto the support plate fixing and conveying unit 30. A front edge portion 20*a* of the element substrate conveying unit 20 is provided with an XYZ stage 21, as illustrated in FIG. 3B. The XYZ stage 21 has a finger 23 for suctioning and grasping the element substrates C through an L-shaped jig 22. In the support plate fixing and conveying unit 30, the support plate 1 can be mounted on an XY stage 31, which is movable in XY-directions, as illustrated in FIG. 3C. The support plate 1 is fixed by using positioning cylinders 32 such that the support plate 1 is abutted against positioning pins 33.

The UV irradiation unit 40 is movable in an X-direction. To irradiate the UV light, the UV irradiation unit 40 moves onto the support plate 1 secured to the support plate fixing and conveying unit 30 and irradiates the UV light toward the support plate 1.

A description will now be given of the positions of cameras used for aligning (positioning) each of the element substrates C with reference to FIG. 4.

Figure 4:
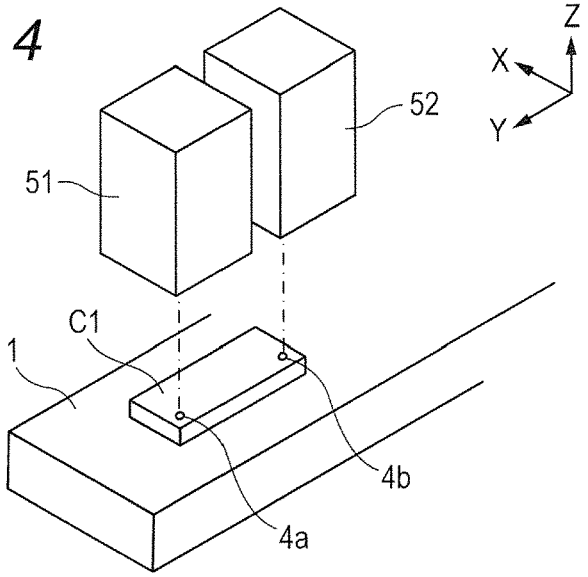
FIG. 4 is a diagram illustrating the positions of the cameras of the mounter.

FIG. 4 illustrates the positional relationship between two cameras mounted on the top part of the support plate fixing and conveying unit 30. A camera 51 shoots the alignment mark 4*a* of the element substrate C. A camera 52 shoots the alignment mark 4*b* of the element substrate C. These two cameras 51 and 52 are movable in a Z-direction so as to permit focus adjustment. The cameras 51 and 52 are secured to the mounter 10 in the X-direction and a Y-direction, thereby maintaining a constant positional relationship in the X-direction and the Y-direction. FIG. 4 illustrates the exemplary alignment of the element substrate C1.

(First Embodiment)

Figure 5:
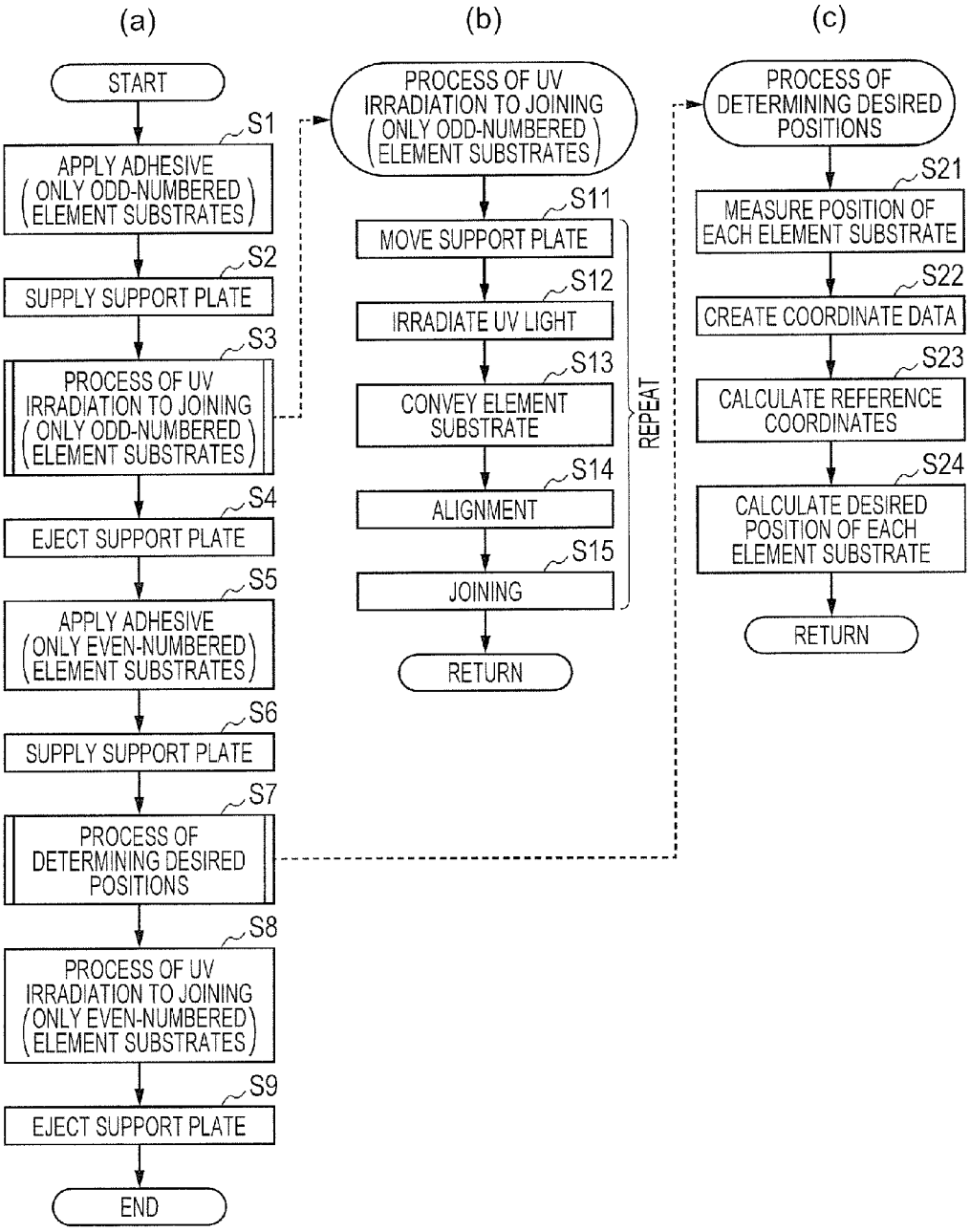
FIG. 5 is a flowchart in the first embodiment.

The process in a first embodiment of the present invention will be described with reference to FIG. 5. (a), (b) and (c) in FIG. 5 are flowcharts illustrating the process for joining a plurality of element substrates C to the support plate 1 in the method for manufacturing a liquid ejection head according to the present embodiment.

First, an adhesive application step S1 of (a) in FIG. 5, which is the first step, will be described with reference to FIG. 6. The adhesive application of step S1 is an example of a first application step.

In step S1, an application device (not illustrated) is used to apply a UV adhesive to the support plate 1 at the positions where the element substrates C are to be joined. The adhesive has to be applied in a shape that matches the element substrates C. Although the shape is rectangular in the present embodiment, the shape is not limited to the rectangle.

Figure 6:
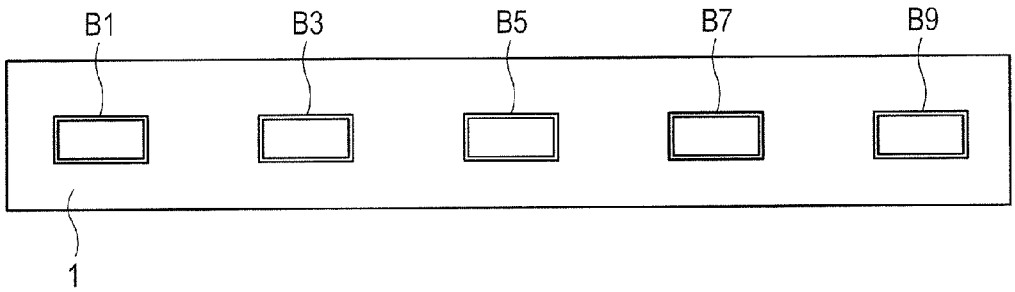
FIG. 6 is a diagram illustrating the application of the adhesive to the positions where odd-numbered element substrates are to be joined in the first embodiment.

In step S1, among the nine areas on the support plate 1 in which the element substrates C1 to C9 are to be disposed, UV adhesives (B1, B3, B5, B7 and B9) are applied to only the areas in which odd-numbered element substrates C (C1, C3, C5, C7 and C9) are to be joined, as illustrated in FIG. 6.

The odd-numbered element substrates C mean the element substrates C that belong to an odd-numbered batch obtained by alternately sorting the element substrates C1 to C9 in order from an end into an odd-numbered batch and an even-numbered batch when all the element substrates C1 to C9 are linearly arrayed (disposed). The odd-numbered batch includes at least one of the two element substrates C positioned at the two ends of the array.

The plurality of areas on the support plate 1 in which the element substrates C that belong to the odd-numbered batch are to be disposed will be areas A1, A3, A5, A7 and A9 illustrated in FIG. 2C. The areas A1, A3, A5, A7 and A9 are examples of a plurality of first areas on the support plate in which the element substrates C that are not adjacent to each other among the plurality of element substrates C are to be disposed. Further, the areas A1, A3, A5, A7 and A9 are also examples of areas where the element substrates C, the orders of which are odd-numbers when counted from the end among the plurality of element substrates C linearly arranged, are to be disposed.

Then, in step S2, the support plate 1 is supplied and fixed to the support plate fixing and conveying unit 30, as illustrated in FIG. 3C.

In next step S3, the processing from the irradiation of the UV light to the UV adhesive applied in step S1 to the joining of the odd-numbered element substrates C is carried out for the element substrates C one by one (the step of UV radiation to the step of joining). The process of the UV radiation to the joining in step S3 is an example of a first joining step. The processing will be described in detail with reference to the flowchart of (b) in FIG. 5.

First, in step S11, the support plate fixing and conveying unit 30 to which the support plate 1 has been secured is moved so as to convey the support plate 1 to a position for joining the element substrate C1.

Thereafter, in step S12, the UV irradiation unit 40 is operated to irradiate the UV light from the UV irradiation unit 40 to the whole area of the UV adhesive B1 applied to the support plate 1. At this time, the UV light is irradiated also to the area to which the UV adhesive B2 for bonding the element substrate C2, which is disposed adjacently to the element substrate C1, is to be applied in step S5, which will be discussed hereinafter.

Figure 7:
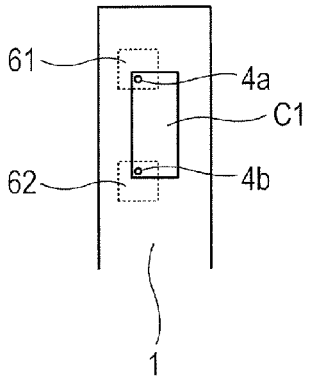
FIG. 7 is a diagram illustrating a state in which a first element substrate has been conveyed in the first embodiment.

Then, in step S13, the element substrate conveying unit 20 is operated to cause the finger 23 to suction the element substrate C1 on the tray 5 and convey the element substrate C1 to a position that is 1 mm above the UV adhesive B1 on the support plate 1. In step S11, the support plate 1 has already been conveyed by the support plate fixing and conveying unit 30 to the position where the element substrate C1 is to be joined. Hence, the state after completion of step S13 observed from above will be as illustrated in FIG. 7. However, the element substrate conveying unit 20 is omitted in FIG. 7. In the illustrated state, the alignment mark 4*a* of the element substrate C1 is positioned in a shooting area 61 of the camera 51, and the alignment mark 4*b* of the element substrate C1 is positioned in a shooting area 62 of the camera 52.

Figure 8A:
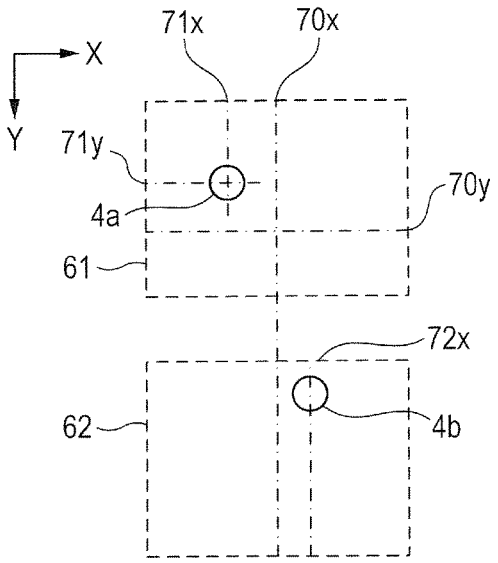
FIGS. 8A and 8B are diagrams illustrating the alignment of the odd-numbered element substrates in the first embodiment.
Figure 8B:
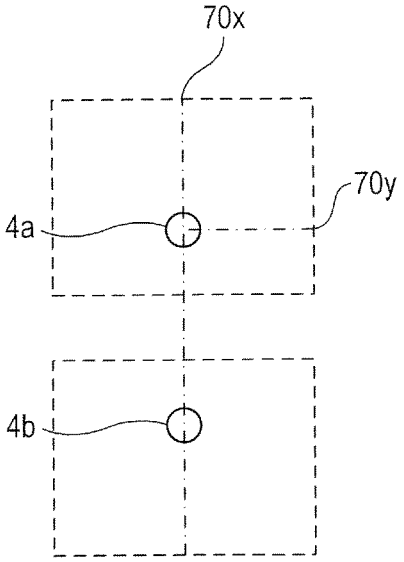

Referring now to FIGS. 8A and 8B, the alignment operation in step S14 will be described.

FIG. 8A illustrates an example of the state in which the images of the alignment marks 4*a* and 4*b* have been detected upon completion of step S13. In FIG. 8A, the detected position in the X-direction of the alignment mark 4*a* is denoted by 71*x*, the detected position in the Y-direction of the alignment mark 4*a* is denoted by 71*y*, and the detected position in the X-direction of the alignment mark 4*b* is denoted by 72*x*.

The desired positions in the X- and Y-directions of the alignment mark 4*a* in this case are 70*x* and 70*y*, and the desired position in the X-direction of the alignment mark 4*b* is 70*x*, as with the alignment mark 4*a*.

Therefore, as illustrated in FIG. 8B, a front edge portion 20*a* of the element substrate conveying unit 20 and the XYZ stage 21 are operated to align (position) the element substrate C1 such that both the alignment marks 4*a* and 4*b* reach the desired positions.

Thereafter, in step S15, the XYZ stage 21 is lowered to join the element substrate C1 to the support plate 1. This completes the joining of the element substrate C1.

Figure 9:
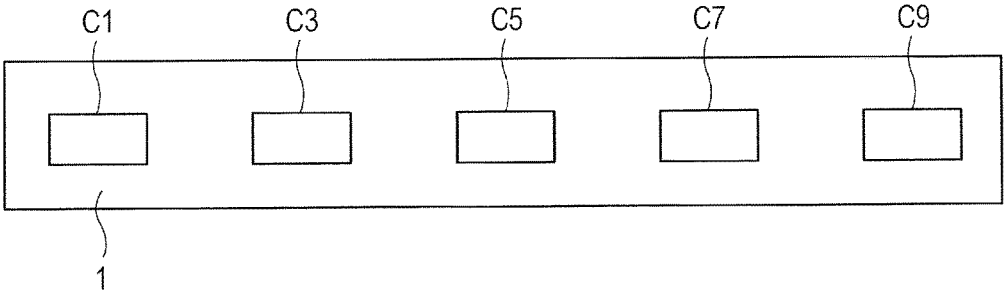
FIG. 9 is a diagram illustrating the odd-numbered element substrates that have been joined in the first embodiment.

Subsequently, the procedure returns to step S11 to carry out the same processing on the element substrates C3, C5, C7 and C9. More specifically, as illustrated in FIG. 9, the process from step S11 to step S15 is repeated until the joining of the element substrate C9 is completed. After the completion of the repeated process, the support plate 1 is ejected from the support plate fixing and conveying unit 30 in step S4 of (a) in FIG. 5.

Figure 1:
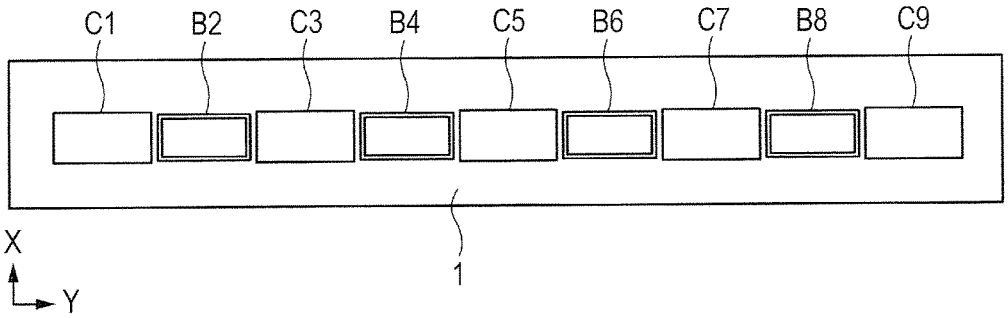
FIG. 1 is a diagram illustrating the application of an adhesive to the positions where even-numbered element substrates are to be joined in a first embodiment.

Then, in step S5, the UV adhesives B2, B4, B6 and B8 are applied to the locations to which the element substrates C have not yet been joined (the areas where the even-numbered element substrates C are to be joined), as illustrated in FIG. 1. The areas where the even-numbered element substrates C are to be joined will be areas A2, A4, A6 and A8 illustrated in FIG. 2C. The adhesive application operation in step S5 is an example of a second application step. Among the plurality of areas on the support plate where the plurality of element substrates are disposed, the areas where the even-numbered element substrates C are to be joined are examples of a plurality of second areas where the element substrates have not yet been joined in the first joining step. The first areas and the second areas are alternately disposed.

Thereafter, in step S6, the support plate 1 is supplied and secured again to the support plate fixing and conveying unit 30. At this time, the support plate 1 will be secured at a slightly different position rather than at exactly the same position even if an attempt is made to secure the support plate 1 at the same position as the position where the support plate 1 was secured in step S2. The positional difference is referred to as the fixing repeatability of the support plate 1 and frequently varies by approximately 20 micrometers. The element substrates C are mounted to be positioned in a straight line at a predetermined pitch. In reality, however, exactly ideal positioning may not be achieved due to the detection repeatability of image processing or the like.

Then, in step S7, the processing for determining the desired positions for aligning the element substrates C2, C4, C6 and C8 is carried out. The processing will be described in detail with reference to the flowchart given in (c) in FIG. 5.

First, in step S21, positions of the element substrates C1, C3, C5, C7 and C9 already joined are measured. The measurement is performed as described below. The support plate fixing and conveying unit 30 is conveyed to the position where each of the element substrates C has been joined, and the image of the alignment mark 4*a* is detected. The result of the detection of the position of the alignment mark 4*a* based on the image is recorded together with the stop position of the XY stage 31 of the support plate fixing and conveying unit 30. This processing is repeated for all the element substrates C joined to the support plate 1. The result of the detection of the position of the alignment mark 4*a* and the stop position of the XY stage 31 of the support plate fixing and conveying unit 30 are examples of the results of position measurement.

Subsequently, in step S22, the position of the alignment mark 4*a* is converted into a two-dimensional coordinate related to an alignment position on the basis of the detected position of the alignment mark 4*a* of each of the element substrates C detected in step S21 and the stop position of the XY stage 31 at the time of the detection in step S21.

If the stop position of an X stage in the XY stage 31 when the alignment mark 4*a* is detected is denoted by Sx and the X position of the image detection result of the alignment mark 4*a* is denoted by Ix, then the X-coordinate Mx of each alignment mark 4*a* is given by the following expression.

$$Mx=Sx+Ix \quad \text{(Expression 1)}$$

Similarly, if the stop position of a Y stage in the XY stage 31 when the alignment mark 4*a* is detected is denoted by Sy and the Y position of the image detection result of the alignment mark 4*a* is denoted by Iy, then the Y-coordinate My of each alignment mark 4*a* is given by the following expression.

$$My=Sy+Iy \quad \text{(Expression 2)}$$

Hereinafter, for the sake of convenience, the Mx of the element substrates C1, C3, C5, C7 and C9 will be denoted by X1, X3, X5, X7 and X9, respectively, and similarly, the My thereof will be denoted by Y1, Y3, Y5, Y7 and Y9, respectively.

Then, in step S23, the coordinates that provide the references of the joining positions of all the element substrates C are calculated. On the coordinate axes illustrated in FIG. 1, a reference coordinate X0 in the X-direction of a reference coordinate is represented by the following expression.

$$X0=\left[\sum_{i=1}^{9} Xi\right]\div 5 \quad \text{(Expression 3)}$$

where "i" takes only odd numbers. If the target pitch of all the element substrates C is denoted by P, then a reference coordinate Y0 in the Y-direction is represented by the following expression.

$$Y0=\left[\sum_{i=1}^{9}\{Yi-P(i-1)\}\right]\div 5 \quad \text{(Expression 4)}$$

where "i" takes only odd numbers.

Next, in step S24, the desired coordinates for aligning the even-numbered element substrates C that have not yet been joined are calculated. The desired coordinate in the X-direction of each of the even-numbered element substrates C is the same as that of X0 in expression 3. If the desired coordinates in the Y-direction of the element substrates C2, C4, C6 and C8 are denoted by Y2, Y4, Y6 and Y8, and the target pitch of all the element substrates C is denoted by P, then the desired coordinates in the Y-direction are represented by the following expression.

$$Yi=Y0+P(i-1) \quad \text{(Expression 5)}$$

where "i" takes only even numbers.

Thus, the desired positions in the X-direction and the Y-direction of the even-numbered element substrates C2, C4, C6 and C8 are determined by the processing of steps S21 to S24.

The procedure then returns to step S8 of (a) in FIG. 5 to carry out the process, on the element substrates one by one, from irradiating the UV light to the UV adhesives B2, B4, B6 and B8 applied in step S5 to the joining of the even-numbered element substrates. At this time, the element substrates are aligned at the desired coordinate positions, which have been calculated as described above, and then joined.

The details of the process in step S8 are the same as those of steps S11 to S15 except that the desired alignment positions are different, and will be therefore omitted.

After the completion of the joining of the element substrate C8, the support plate 1 is ejected from the support plate fixing and conveying unit 30 in step S9. This completes the entire process.

Thus, according to the present embodiment, the application of the UV adhesives B1 to B9 and the joining of the element substrates C1 to C9 are carried out in two batches, i.e. carried out separately for the odd-numbered element substrates and for the even-numbered element substrates. This makes it possible to avoid the inconvenient progress of the curing reaction of the adjacent UV adhesive when irradiating the UV light.

Further, for each element substrate, the light is irradiated to a UV adhesive to join the element substrate, thus permitting a reduction in time required from the irradiation of light to an adhesive droplet to the joining of an element substrate. Thus, the element substrates can be joined at predetermined positions, making it possible to reduce the variations in positions of the element substrates.

Further, the adhesive is applied to the plurality of areas in which the odd-numbered element substrates are to be disposed and then the light is irradiated to one area at a time to join one odd-numbered element substrate. Then, the adhesive is applied to the plurality of areas in which the even-numbered element substrates are to be disposed and then the light is irradiated to one area at a time to join one even-numbered element substrate. Hence, the frequency of attaching and detaching the support plate 1 to and from the mounter 10 can be reduced and an increase in the tact time can be avoided, as compared with the case where the three steps, namely, the application of an adhesive, the irradiation of light, and the joining of an element substrate, for each element substrate is defined as one cycle and the cycle is repeated for the quantity of the element substrates.

Further, before joining the even-numbered element substrates, the positions of all the odd-numbered element substrates that have been joined are measured to calculate the alignment positions of the even-numbered element substrates. Hence, the variations in the relative positions of all the element substrates can be reduced.

Further, the UV light is irradiated to the UV adhesives B1, B3, B5, B7 and B9 in the state wherein the element substrates C1, C3, C5, C7 and C9 are not placed on the UV adhesives B1, B3, B5, B7 and B9. Therefore, the element substrates C1, C3, C5, C7 and C9 do not block the UV light irradiated to the UV adhesives B1, B3, B5, B7 and B9. Hence, the UV light can be irradiated to the entire area of the UV adhesives B1, B3, B5, B7 and B9, making it possible to cure the UV adhesives B1, B3, B5, B7 and B9 across the entire area. This in turn makes it possible to prevent the elution of an uncured UV adhesive to a liquid, such as an ink.

Further, the UV light is irradiated to the UV adhesives B2, B4, B6 and B8 in the state wherein the element substrates C2, C4, C6, and C8 are not placed on the UV adhesives B2, B4, B6 and B8. Therefore, it is possible to prevent the elution of an uncured UV adhesive to a liquid, such as an ink, also in the case of the UV adhesives B2, B4, B6 and B8.

(Second Embodiment)

A description will now be given of a second embodiment of the present invention. In the present embodiment, like parts as those in the first embodiment will be assigned like reference numerals as those in the first embodiment.

Figure 10:
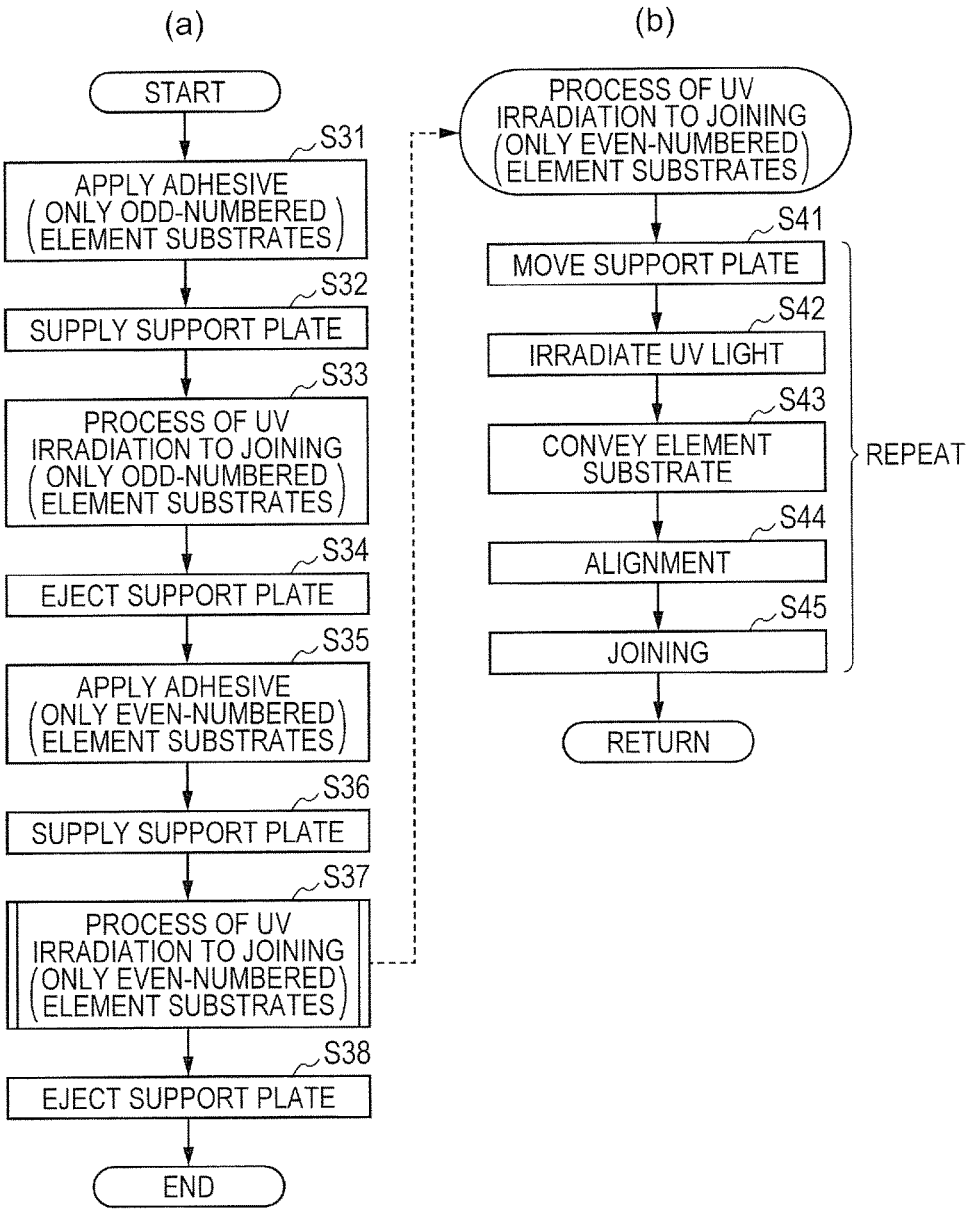
FIG. 10 is a flowchart in a second embodiment.

The processing in the present embodiment will be described with reference to FIG. 10. (a) and (b) in FIG. 10 are flowcharts illustrating the process for joining a plurality of element substrates C to a support plate 1 in the method for manufacturing a liquid ejection head according to the present embodiment. The processing in steps S31 to S36 of (a) in FIG. 10 is the same as that in steps S1 to S6 in the first embodiment, so that the description thereof will be omitted. The position of the support plate 1 supplied in step S36 is not exactly the same position as the position thereof supplied in step S32, as described in relation to the first embodiment.

To join even-numbered element substrates C in step S37, the operation of steps S41 to S45 of (b) in FIG. 10 is repeated for the quantity of the element substrates. The operation in step S37 is an example of a second application process.

First, the operation for joining an element substrate C2 will be described.

In step S41, a support plate fixing and conveying unit 30 is driven so as to set a support plate 1 to the position where the element substrate C2 is to be joined.

Subsequently, in step S42, a UV irradiation unit 40 is operated to irradiate UV light to a UV adhesive B2.

Figure 11:
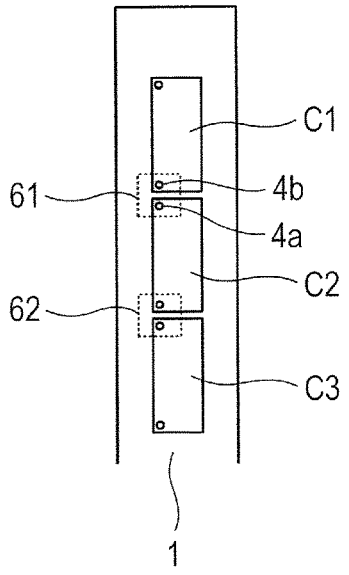
FIG. 11 is a diagram illustrating a state in which a second element substrate has been conveyed in a second embodiment.

Then, in step S43, an element substrate conveying unit 20 is operated to cause a finger 23 to suction the element substrate C2 on a tray 5 and then convey the element substrate C2 to a position that is 1 mm above the UV adhesive B2 on the support plate 1. In step S41, the support plate 1 has already been conveyed by the support plate fixing and conveying unit 30 to the position where the element substrate C2 is to be joined. Hence, the state after completion of step S43 observed from above will be as illustrated in FIG. 11. More specifically, the element substrate C2 to be joined is positioned between adjacent element substrates C1 and C3 and approximately 1 mm above the support plate 1. In the drawing, the element substrate conveying unit 20 is omitted. An alignment mark 4*b* of the element substrate C1 and an alignment mark 4*a* of the element substrate C2 are positioned in a shooting area 61 of a camera 51, and the alignment mark 4*b* of the element substrate C2 and the alignment mark 4*a* of an element substrate C3 are positioned in a shooting area 62 of a camera 52.

Figure 12A:
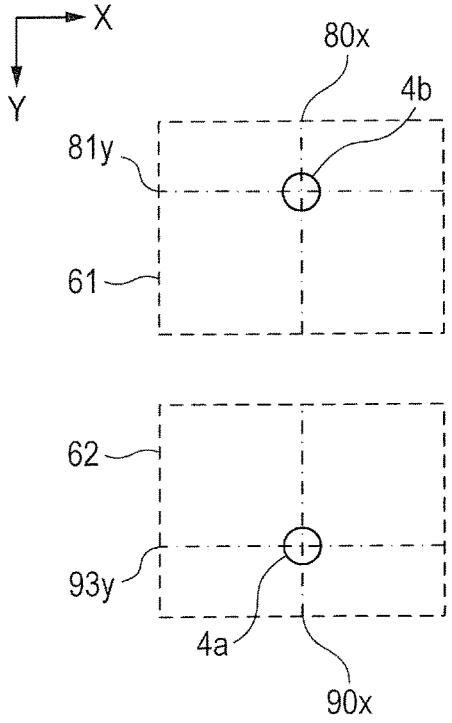
FIGS. 12A and 12B are diagrams illustrating the alignment of the even-numbered element substrates in the second embodiment.
Figure 12B:
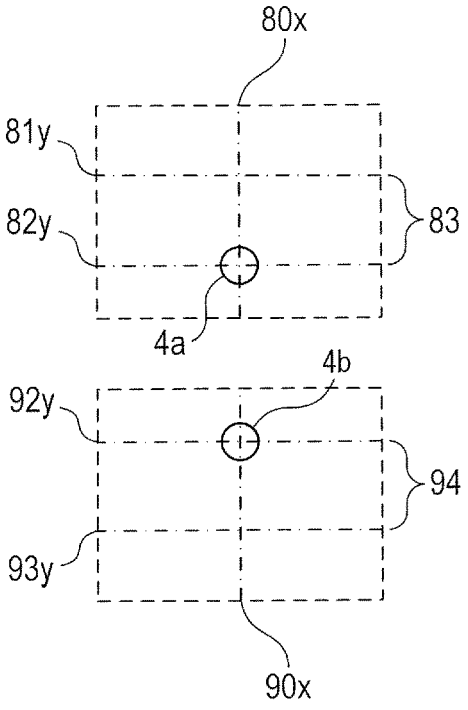

Referring now to FIGS. 12A and 12B, the alignment operation in step S44 will be described.

FIG. 12A illustrates an example of the state in which the cameras 51 and 52 have been focused on the element substrates C1 and C3, which have been joined, and the images of the alignment mark 4*b* of the element substrate C1 and the alignment mark 4*a* of the element substrate C3 have been detected. In the shooting area 61 of the camera 51, the alignment mark 4*b* of the element substrate C1 is seen at the coordinate position defined by 80*x* in the X-direction and 81*y* in the Y-direction. Further, in the shooting area 62 of the camera 52, the alignment mark 4*a* of the element substrate C3 is seen at the coordinate position defined by 90*x* in the X-direction and 93*y* in the Y-direction. The coordinate positions of the alignment marks are stored.

Subsequently, both the cameras 51 and 52 are raised and focused on the element substrate C2 to detect the images of the alignment marks 4*a* and 4*b* of the element substrate C2 by the cameras 51 and 52. Then, an XYZ stage 21 of the element substrate conveying unit 20 is adjusted such that the positions of the alignment marks 4*a* and 4*b* in the X-direction reach 80*x* and 90*x*, respectively, that are the positions most recently stored, as illustrated in FIG. 12B.

Further, the XYZ stage 21 is adjusted to set a difference 83, which is the difference between 82*y* indicative of the position of the alignment mark 4*a* in the Y-direction and 81*y* indicative of a most recently stored position, and a difference 94, which is the difference between 92*y* indicative of the position of the alignment mark 4*b* in the Y-direction and 93*y* indicative of a most recently stored position, to the same length. This adjustment may or may not be performed at the same time the positions of the alignment marks 4*a* and 4*b* in the X-direction are adjusted.

After that, in step S45, the XYZ stage 21 is lowered to join the element substrate C2 to the support plate 1. This completes the mounting of the element substrate C2.

Thereafter, the process from step S41 to S45 is repeated to join the element substrates C4, C6 and C8 in the same manner. The same processing is carried out although the position of the conveyance by the support plate fixing and conveying unit 30 in step S41 is different and two element substrates adjacent to the element substrate are different accordingly from those in the case where the element substrate C2 is joined.

Thus, according to the present embodiment, the application of UV adhesives B1 to B9 and the joining of the element substrates C1 to C9 are carried out in two batches, i.e. carried out separately for the odd-numbered element substrates and for the even-numbered element substrates. This makes it possible to avoid the inconvenient progress of the curing reaction of the adjacent UV adhesive when irradiating the UV light. Further, the joining position of an even-numbered element substrate is between two adjacent element substrates that have already been mounted, so that the relative positional variations of adjacent element substrates can be reduced.

(Third Embodiment)

A description will now be given of a third embodiment of the present invention. In the present embodiment, like parts as those in the first or the second embodiment will be assigned like reference numerals as those in the first or the second embodiment.

In the first and the second embodiments, only the UV adhesive has been used as the adhesive for joining the element substrates C and the support plate 1. The present embodiment uses two types of adhesives, namely, an adhesive that does not require the irradiation of UV light for curing and a UV adhesive. In the present embodiment, as the adhesive that does not require the irradiation of UV light for curing, an adhesive that has properties in that the adhesive does not cure until being subjected to heat (hereinafter referred to as the thermosetting adhesive).

The present embodiment differs from the first embodiment in the application of adhesives because of the additional type of adhesive to be used.

Figure 13:
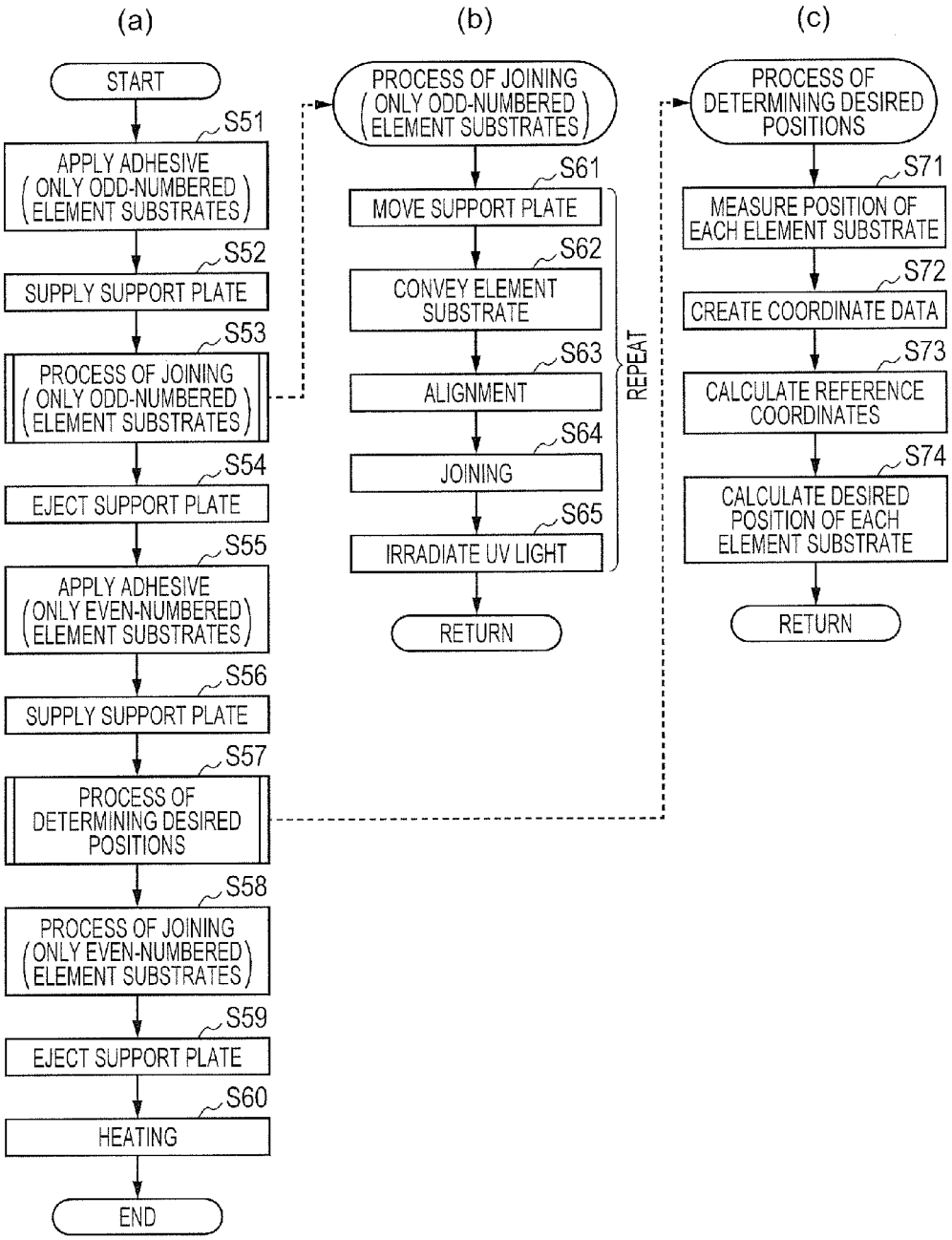
FIG. 13 is a flowchart in a third embodiment.

The process according to the present embodiment illustrated in FIG. 13 is the same as that according to the first embodiment illustrated in FIG. 5 except for the timing of the irradiation of UV light. Hence, the present embodiment will be described, centering around the aspects that are different from the first embodiment.

In step S51, an adhesive is applied to locations where odd-numbered element substrates C are to be joined.

Figure 14:
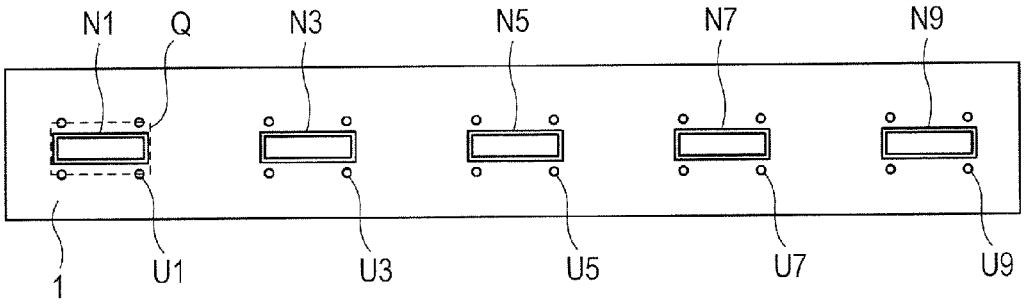
FIG. 14 is a diagram illustrating the applied adhesive in the third embodiment.

As illustrated in FIG. 14, a thermosetting adhesive N (N1, N3, N5, N7 and N9) is applied in a rectangular shape, and a UV adhesives U (U1, U3, U5, U7 and U9) is applied in an approximately circular shape around the rectangular adhesive droplets. The UV adhesive U is applied to four locations per element substrate, each adhesive droplet being positioned such that approximately a half of the spot extends beyond an area Q (denoted by the dashed line in the drawing) wherein the element substrate is to be joined. Further, the adhesives are applied in the same shapes in step S55. The number of locations where the UV adhesive is applied per element substrate may be two or three rather than being limited to four.

According to the first embodiment, the UV light is irradiated to the adhesive before joining the element substrates C (before conveying the element substrates). According to the present embodiment, in the joining process of (b) in FIG. 13, the UV light is irradiated in step S65 after the joining of an element substrate in step S64.

In the irradiation process according to the present embodiment, the UV light is irradiated to the UV adhesive U, with an XYZ stage 21 down, and the XYZ stage 21 is raised after the irradiation. At this time, the UV light is irradiated to the UV adhesive U exposed outside an element substrate C. The inside thermosetting adhesive N does not cure unless heated. Hence, the element substrate C joined only with the thermosetting adhesive N in this state at this stage may be dislocated if subjected to any external force before the adhesive N is thermally cured. For this reason, the UV adhesive U is used to avoid unexpected dislocation of the element substrate C. A part of the UV adhesive U that is covered under the element substrate C is not exposed to the UV light and therefore does not completely cure. However, a liquid, such as an ink, will not come in contact with the UV adhesive U although the liquid comes in contact with the inner side of the thermosetting adhesive N. This makes it possible to prevent the elution of an uncured UV adhesive U into the liquid, such as an ink.

The support plate 1 with all the element substrates C joined thereto with the UV adhesive U is ejected in step S59, and then the support plate 1 is heated using an oven (not illustrated) in step S60 to cure the thermosetting adhesive N. This completes the joining process. Step S60 is an example of a third joining operation in which the thermosetting adhesive is heated after the second joining operation, thereby further joining the element substrates by the thermosetting adhesive to first areas and second areas.

Thus, according to the present embodiment, even when a plurality of types of adhesives, including the UV adhesive, are used, the application of the adhesive droplets N1 to N9 and U1 to U9 and the joining of the element substrates C1 to C9 are carried out in two batches, i.e. carried out separately for the odd-numbered element substrates and for the even-numbered element substrates. This makes it possible to avoid the inconvenient progress of the curing reaction of adjacent UV adhesive when irradiating the UV light.

In the foregoing embodiments, the application of the UV adhesive and the joining of the element substrates have been performed in two batches, i.e., performed separately for the odd-numbered element substrates and the even-numbered element substrates. Alternatively, however, a plurality of element substrates may be divided into three or more batches, and the application of the UV adhesive and the joining of the element substrates may be performed for each batch. In this case, each batch will include two or more element substrates, and the element substrates that belong to the same batch will be disposed such that these element substrates will not be adjacent to each other.

For example, a plurality of element substrates can be divided into three batches, namely, a first batch to a third batch, and the UV adhesive can be applied and the element substrates can be joined in the order of the first batch, the second batch and the third batch. In this case, the UV adhesive application step for the first batch will be an example of the first application step. The joining step for the first batch will be an example of the first joining step. The UV adhesive application step for the second or the third batch will be an example of the second application step. If the UV adhesive application step for the second batch is the second application step, then the joining step for the second batch will be an example of the second joining step. If the UV adhesive application step for the third batch is the second application step, then the joining step for the third batch will be an example of the second joining step.

In the embodiments described above, the illustrated configurations are merely examples and the present invention is not limited to the configurations.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-113096, filed Jun. 3, 2015, which is hereby incorporated by reference herein in its entirety.

What is claimed is:

1. A method for manufacturing a liquid ejection head, in which a plurality of element substrates that eject a liquid are adjacently arranged in a predetermined direction on a support member as odd-numbered element substrates and even-numbered element substrates counted from one end of the support member in the predetermined direction by using an adhesive that cures by irradiation of light, the manufacturing method comprising:

a first application step of applying the adhesive to a plurality of first areas on a surface of the support member at which each of all of the odd-numbered element substrates is to be arranged;

a first fixing step of fixing the support member, to which the adhesive has been applied to the first areas, to a fixing and conveying unit;

a first joining step of moving the support member to move the fixing and conveying unit to a position for joining each of the odd-numbered element substrates, and carrying out the irradiation of light and the joining of all of the odd-numbered element substrates for each of the first areas to which the adhesive has been applied in the first application step;

a step of removing the support member, to the first areas of which all of the odd-numbered element substrates are joined, from the fixing and conveying unit;

a second application step of applying the adhesive to a plurality of second areas, which are adjacent to the first areas where the odd-numbered element substrates have been joined, on the surface of the support member and at which each of all of the even-numbered element substrates is to be arranged;

a second fixing step of fixing the support member, to which the adhesive has been applied to the second areas, to the fixing and conveying unit; and a second joining step of moving the support member to move the fixing and conveying unit to a position for joining each of the even-numbered element substrates, and carrying out the irradiation of light and the joining of all of the even-numbered element substrates for each of the second areas to which the adhesive has been applied in the second application step, wherein, in the first joining step, a series of the moving of the support member, the irradiation of light, and the joining of the odd-numbered element substrates is carried out for each of the first areas from the one end of the support member to the other end of the support member, and wherein, in the second joining step, a series of the moving of the support member, the irradiation of light, and the joining of the even-numbered element substrates is carried out for each of the second areas from the one end of the support member to the other end of the support member.

2. The method according to claim 1, wherein the first areas and the second areas are alternately arranged in the predetermined direction.

3. The method according to claim 1, wherein, in the second joining step, the even-numbered element substrates to be joined in the second joining step are positioned based on positions of the odd-numbered element substrates joined in the first joining step.

4. The method according to claim 3, wherein the positions of the odd-numbered element substrates joined in the first joining step are measured, and desired positions of the even-numbered element substrates to be joined in the second joining step are calculated to perform the positioning based on position measurement results.

5. The method according to claim 3, wherein positions of the even-numbered element substrates to be joined in the second joining step are determined by referring to positions of the odd-numbered element substrates which are adjacent to the even-numbered element substrates to be joined in the second joining step and which have been joined in the first joining step.

6. The method according to claim 1, comprising:

applying a thermosetting adhesive to the first areas in the first application step; and applying the thermosetting adhesive to the second areas in the second application step, wherein the second joining step is followed by a third joining step, in which the thermosetting adhesive is heated to join the element substrates to the first areas and the second areas by the thermosetting adhesive.

7. The method according to claim 1, wherein the plurality of the element substrates are linearly and adjacently arranged.

8. The method according to claim 1, wherein arranging of the odd-numbered element substrates on the plurality of the first areas is carried out after the irradiation of light in the first joining step and arranging of the even-numbered element substrates on the plurality of the second areas is carried after the irradiation of light in the second joining step.

9. The method according to claim 1, wherein the irradiation of the light in the first joining step irradiates a part of the second areas before the adhesive has been applied thereto.

10. The method according to claim 1, wherein, in the first application step, the adhesive is applied so that a part of the adhesive is positioned outside of the odd-numbered element substrates in the first joining step, and wherein, in the second application step, the adhesive is applied so that a part of the adhesive is positioned outside of the even-numbered element substrates in the second joining step.

11. The method according to claim 10, wherein arranging of the odd-numbered element substrates on the plurality of the first areas is carried out before the irradiation of light in the first joining step and arranging of the even-numbered element substrates on the plurality of the second areas is carried out before the irradiation of light in the second joining step.

12. The method according to claim 6, wherein, in the first application step, the adhesive that cures by irradiation of light is applied in the first area at an outer position with respect to the thermosetting adhesive, and wherein, in the second application step, the adhesive that cures by irradiation of light is applied in the second area at an outer position with respect to the thermosetting adhesive.

13. The method according to claim 1, wherein, in the first application step, the adhesive is applied to the plurality of the first areas from the one end of the support member to another end of the support member one by one, and wherein, in the second application step, the adhesive is applied to the plurality of the second areas from the one end of the support member to the other end of the support member one by one.

* * * * *